United States Patent [19]

Heinz

[11] 4,014,083

[45] Mar. 29, 1977

[54] DRAW-IN GRIPPER ASSEMBLY FOR DRAWING-IN WARP THREADS

[75] Inventor: John Heinz, Berneck, Switzerland

[73] Assignee: Lindauer Dornier Gesellschaft mbH., Germany

[22] Filed: Aug. 5, 1975

[21] Appl. No.: 602,084

[30] Foreign Application Priority Data

Sept. 18, 1974 Germany ..... 2444566

[52] U.S. Cl. ..... 28/46

[51] Int. Cl.[2] ..... D03J 1/14

[58] Field of Search ..... 28/42–46, 28/41; 139/380, 381, 122 N

[56] References Cited

UNITED STATES PATENTS

| | | | |
|---|---|---|---|
| 255,038 | 3/1882 | Sherman et al. | 28/46 X |
| 282,124 | 7/1883 | Sherman | 28/46 X |
| 755,861 | 3/1904 | Field | 28/46 |
| 2,230,494 | 2/1941 | Kieke | 28/46 X |
| 3,384,126 | 5/1968 | Golobart | 139/122 N |

FOREIGN PATENTS OR APPLICATIONS

| | | | |
|---|---|---|---|
| 1,439,965 | 4/1966 | France | 139/122 N |

*Primary Examiner*—James Kee Chi
*Attorney, Agent, or Firm*—James E. Bryan

[57] ABSTRACT

A draw-in gripper assembly for drawing warp threads into weaving components including holding means mounted above one another for holding a plurality of warp threads, fed off of a beam, in place, each individual warp thread forming a loop outside of the clamping point of the upper holding means and being held in position by the lower holding means, draw-in gripper means mounted above the lower holding means, slider head means in the gripper means adapted to clamp a warp thread and pull it from the lower holding means during a draw-in stroke of the gripper means, the warp thread, held in a loop in the upper holding means, being released after a short delay, and, due to the length of thread so released, the warp thread is pulled through eye means of a weaving component, and means for releasing the warp thread from the gripper means at the end of the draw-in stroke.

7 Claims, 7 Drawing Figures

DRAW-IN GRIPPER ASSEMBLY FOR DRAWING-IN WARP THREADS

Figures 1, 1A, 1B:
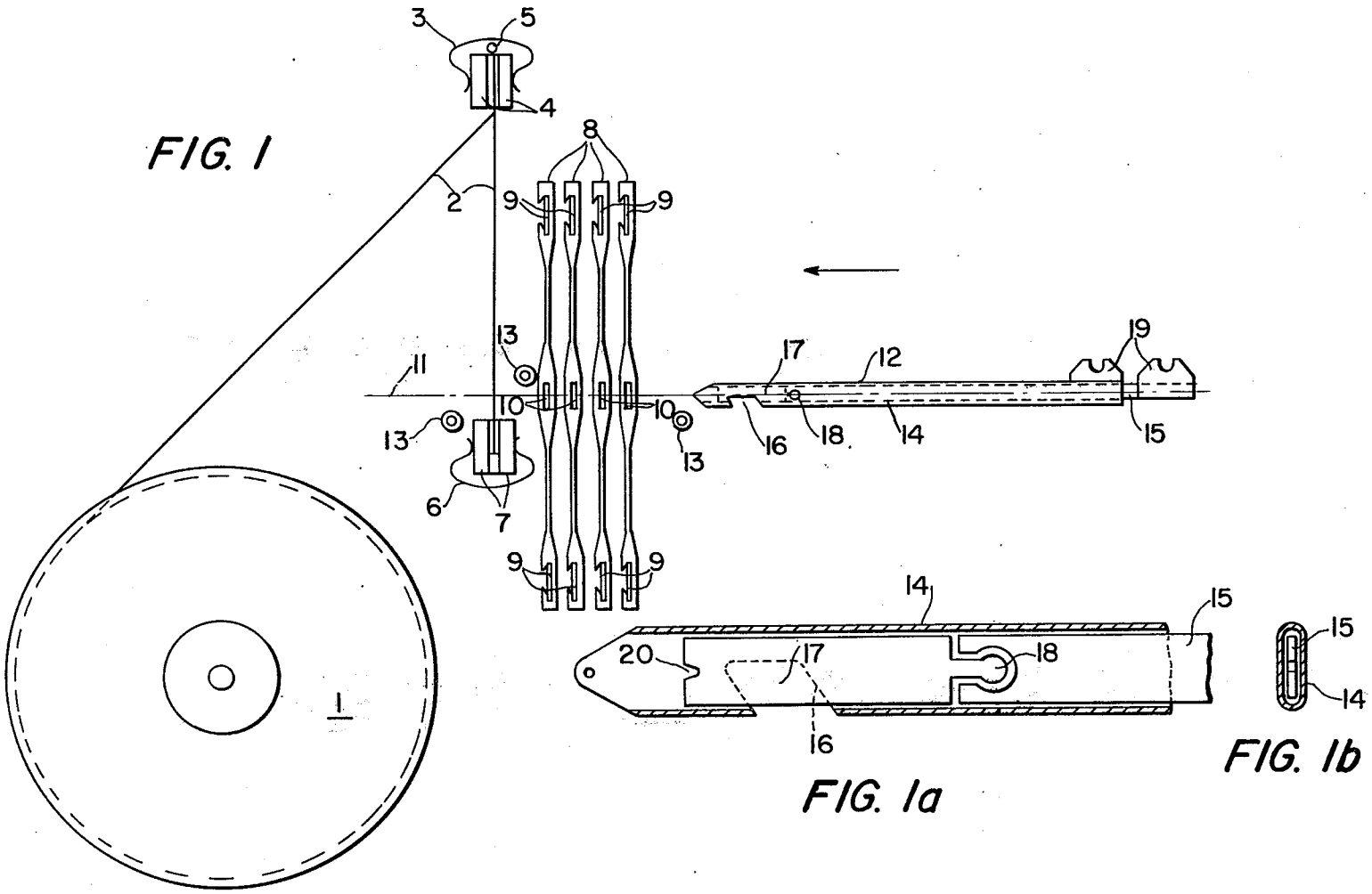

The invention relates to a draw-in gripper assembly for drawing warp threads into the weaving parts of a loom.

In practice, warp drawing-in processes and associated equipment are known, which make use of a drawing-in needle with a thread eye thereon, the warp thread being inserted by means of an associated slot. Depending upon the size of the thread eye fashioned in the heddle and the kind of warp material to be drawn-in, the eye and the insertion slot will be of different designs. Heretofore, a warp was tensioned and the warp ends were held by a clip. Using suitable and known means to separate a thread from the multitude of the others, and by slanting the same, it will be inserted into the eye of the draw-in needle. The thread end is removed from the clip during the return stroke or return motion, the free end of the thread firmly lying on the loom being drawn in a loop-like manner through the eye of the draw-in needle during needle motion. Because of the slim dimensions of the draw-in needle, there remains only an extremely small radius for the loop of the thread.

When drawing coarsely structured threads (for instance burling, loop, crimped structures and the like) into the eye of the draw-in needle, difficulties will be encountered on that account. The coarse thread structure (burling, loops, etc.) hampers plain sliding through the eye, so there will be frequent rupture of the thread. Hence, quite often the structured warp material may not be drawn-in by the machine when using the warp draw-in machines heretofore employed, this time-consuming and complex process having to be performed manually.

German Offenlegungsschrift No. 2,318,249, discloses a process and equipment for drawing-in warp threads which allows pulling a short yarn section through the first set of weaving parts, a projecting end section of the yarn being left in front of the parts and a short segment of yarn being pulled through the further set of weaving components. The drawback in this instance is that only short segments of yarns or warp materials may be passed through the eyes of the draw-in needles, i.e., warp threads fed off of looms in finite lengths may not be processed, or only in a cumbersome manner.

The present invention is based on this state of affairs, and provides for the inserting or drawing-in and passing of warp threads of various kinds, especially of a coarse kind, through the eyes of heddles and drop wires in contrast to the conventional draw-in process with the least possible friction of the individual threads against the edges of the eyes or of the weaving components. Another goal is to prevent formation of thread loops allowing double passage of thread through the eye during drawing-in, and to achieve draw-in of all textile materials without thread rupture.

In the invention, a plurality of warps fed off of the loom are held by known holding devices and arranged one above the other, each single warp thread outside the fastening site at the upper holding devices forming a loop, the end of all warp threads in the lower holding devices being held in place, and the warp threads so held are gripped by draw-in grippers above the fastening sites of the lower holding devices. The warp threads are clamped therein by a slider-head and are pulled out of the lower holding devices during their draw-in stroke, upon a short delay the warp theads held in loops in the upper holding devices are released and the length of thread of the warps so released are pulled through the eyes of the weaving parts, the thread ends being released by the draw-in grippers at the end of the draw-in stroke.

In a further embodiment, the invention provides for the design of the draw-in gripper as a slider in a gripper tube or sheath. Advantageously, the slider is equipped with an exchangeable head at that end facing the warp thread. The slider head suitably is provided with a clamping slot at its end face. Lastly, the gripper tube or sheath is provided at the height of the slider head with a gripper groove oblique in the direction of the positioned warp thread. Furthermore, elastic coupling elements engage the drivers mounted at the drive ends of the slider and gripper tube or sheath.

The advantages obtained by the invention are especially that the warp threads to be pulled into the heddles or drop wires will be clamped at their ends in the draw-in grippers and that these warps will be pulled into and through the eyes in their thread or gripper grooves in the position of rest without formation of loops which might allow the threads to pass twice through the eyes during the draw-in thereof. Therefore, textile yarn materials of any structure may be drawn into the weaving parts without thread rupture. In comparison with conventional draw-in methods, the friction of the wrap threads to be drawn-in at the eyes of the weaving parts will be reduced by more than half. Because the slider head of the draw-in gripper is exchangeable, its material and thickness may be adapted to the particular warp material being drawn-in. Furthermore, the clamping slot in the slider head and the soft-material design of the head allow clamping the warp threads without kinking. This permits drawing-in sensitive warp materials such as glass fibers and the like without thread rupture.

Figures 2, 2A:
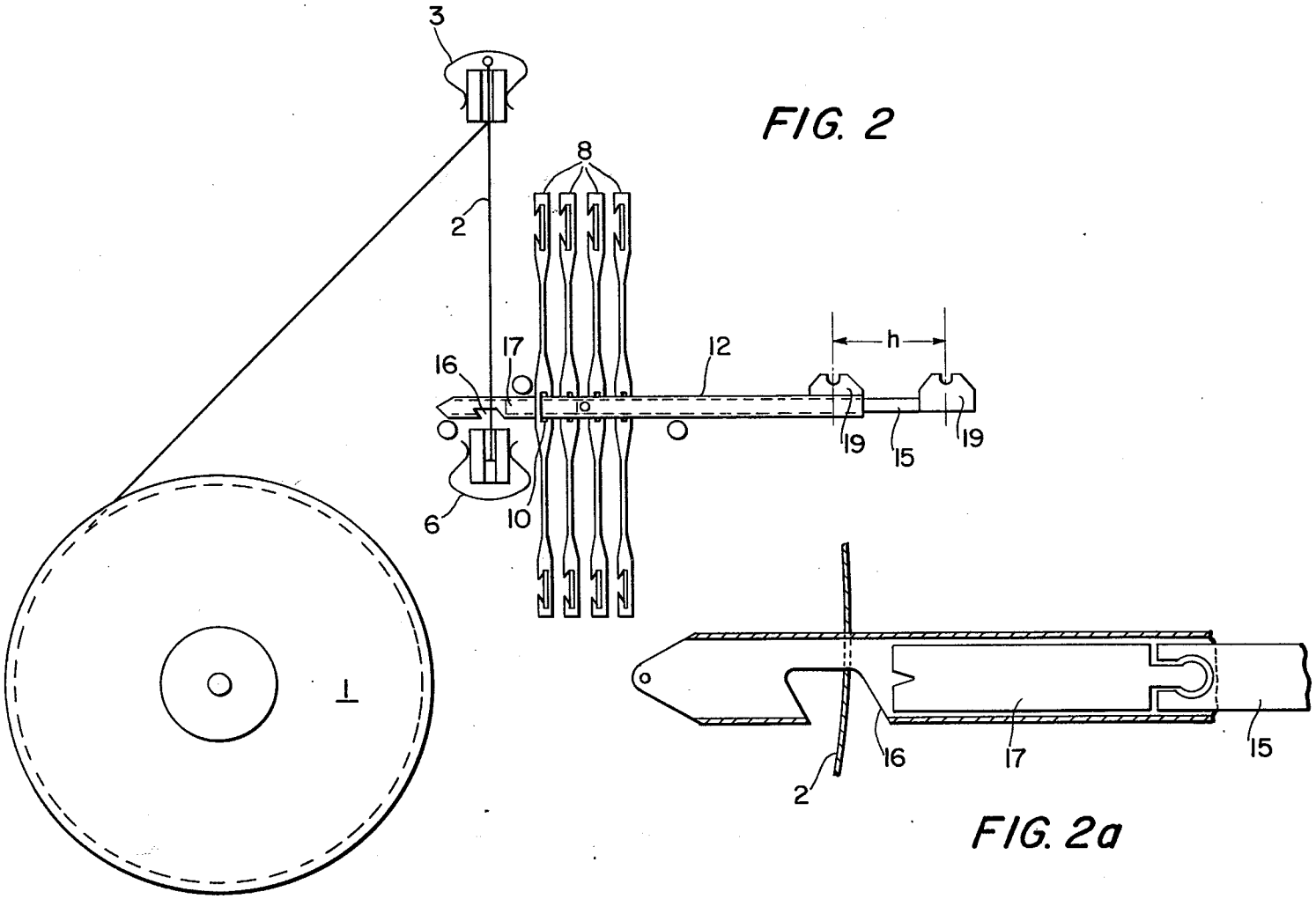
Figures 3, 3A:
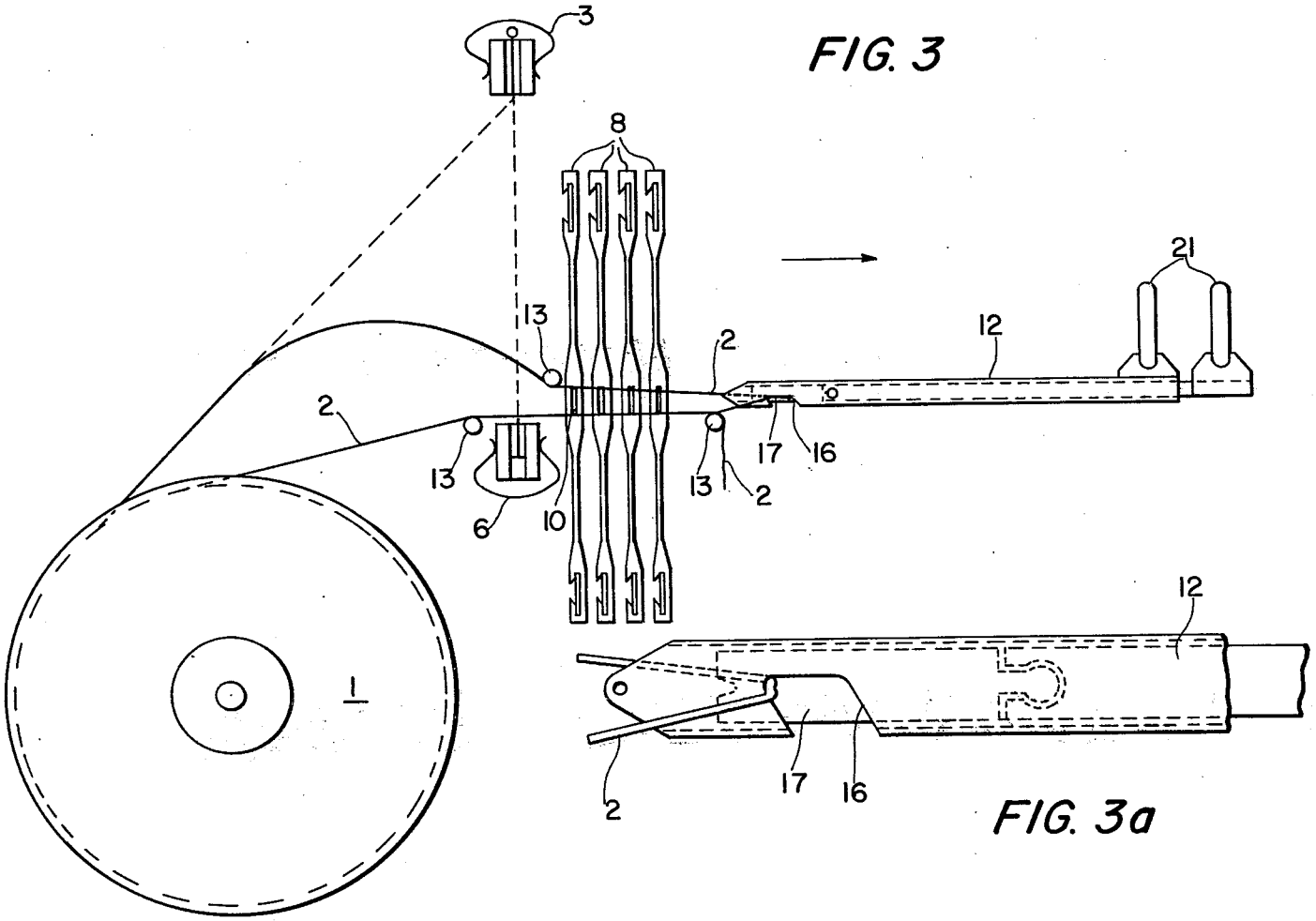

One embodiment is described below and illustrated by the accompanying drawings, in which:

FIG. 1 is a side view of a loom feeding a plurality of warp threads held in the draw-in position by holding devices, with weaving components and draw-in grippers being mounted in front of the warps, FIG. 1*a* is an enlargement of the draw-in gripper of FIG. 1 with an exchangeable and closed slider head, FIG. 1*b* is a cross-sectional view through the draw-in gripper of FIG. 1*a*, FIG. 2 is a view such as FIG. 1 with the draw-in grippers guided through a weaving component and in the gripping position, FIG. 2*a* shows the draw-in gripper of FIG. 1*a* in the gripping position with an open slider head, FIG.3 shows views of FIGS. 1 and 2 with a warp thread released from its holding devices, and being pulled through the weaving component by the draw-in gripper, and FIG. 3*a* shows the draw-in gripper of FIGS. 1*a* and 2*a* in the clamping position.

The plurality of warps 2, fed off of the loom 1 in FIG. 1, first are guided obliquely to the upper holding devices 3. Each of latter holds a single warp thread 2 in clamping jaws 4 in such a manner that every warp thread is doubly clamped and forms a loop 5 outside and upwardly of the jaws. Warp threads 2 hanging loosely downwardly from the upper holding devices 3 are gripped at their lower ends by the lower holding devices 6 or their clamping jaws 7 and are simultaneously held or clamped. The heddles 8 are mounted immediately behind the vertical plurality of warps 2, supported by the heddle-bearing rails 9 and guided by the same. The eyes 10 in the heddles 8 are located in a plane 11 closely above the lower holding devices 6, the plane at the same time being the operational plane for the draw-in grippers 12 mounted so as to reciprocate laterally from the heddles 8. The thread support rods 13 are mounted in front of the plurality of warps 2 and also between the latter and the heddles 8 on one hand and between the heddles and the top ends of the draw-in grippers 12 on the other hand.

The draw-in gripper 12, which is in the position of rest, is composed of a gripper tube or of a gripper sheath 14 inside of which a gripper slider 15 is movably supported and at the end of which a gripper groove 16 is provided. At the slider end, there is a slider head 17 secured by a locking or safety device 18 and thus provision is made for an exchangeable slider head made from a suitable hard or soft material, corresponding to the warp material being used (see FIGS. 1*a* and 1*b*). The other end of the gripper slider 15 is equipped with a drive fork 19 by means of which the slider may be moved to and fro inside the gripper tube or sheath 14. If the draw-in gripper 12 is moved into the operational position (see the directional arrow), the gripper slider 15, together with its slider head 17, will move in the opposite direction, so that prior to the gripper groove 16 passing through the eye 10, the slider head 17 will release the gripper groove 16 (see also FIGS. 2 and 2*a*). The slider head 17 at its end face is provided with a clamping slot 20 (FIG. 1*a*) permitting the clamping of the thread without kinking it and with the help of which sensitive warp materials such as glass fibers and the like may be drawn-in without being ruptured.

In FIG. 2, the draw-in gripper 12 is moved toward the heddles 8 (see the directional arrow), the gripper groove 16 being guided through the eye 10 of the heddle 8 nearest to the warp threads 2 vertically clamped by the two holding devices 3 and 6. The gripper slider 15 remains behind by the amount of the clamping stroke *h*, so that the slider head 17 releases the gripper groove 16 (see also FIG. 2*a*) and hooks into the warp thread 2. By suitably controlling the two drive forks 19, the clamping stroke *h* may be adapted to the particular thicknesses and materials of the warp threads 2 being drawn-in, i.e., it may be lengthened or shortened in such a manner.

FIG. 3 shows the draw-in gripper 12 again in its initial position (FIG. 1, see directional arrow). In the process, the end of warp thread 2 clamped by the slider head 17 into the gripper groove 16 (also see FIG. 3*a*) is pulled through the eye 10 of the heddle 8. Shortly before the reverse stroke of the draw-in gripper 12, the warp thread 2 is released by both holding devices 3 and 6, the thread end first being released from the lower holding device 6. Only thereupon will there be release of the warp 2 from the upper holding device 3(see the dashed line from the loom 1 to the holding device 3), the warp thread first sliding on the thread support rod 13 mounted to the most adjacent heddle 8 to the holding devices 3 and 6 and located beside the plane of the holding devices (dashed line). Upon completion of the reverse stroke of the draw-in gripper 12, the warp thread falls onto the two lower support rods 13 mounted in front of the holding device 6 and behind the last heddle 8. The warp thread 2 will be guided in this manner on both thread support rods 13. Upon completion of the reverse stroke of the draw-in gripper 12, the thread end then will be released by the slider head 17 from the gripper groove 16.

In order to avoid rupture of the draw-in grippers 13, the drive forks 19, which are open to one side, are equipped with elastic coupling beams 21 (for instance made of rubber, plastics, etc.) coupled to the gripper tube or sheath 14 and to the gripper slider 15. Therefore, in case of draw-in gripper impact, the gripper may move toward an improperly positioned heddle.

It will be obvious to those skilled in the art that many modifications may be made within the scope of the present invention without departing from the spirit thereof, and the invention includes all such modifications.

What is claimed is:

1. A draw-in gripper assembly for drawing warp threads into weaving components comprising holding means mounted above one another for holding in place a plurality of warp threads fed off of a beam, each individual warp thread forming a loop outside of the clamping point of the upper holding means and being held in position by the lower holding means, draw-in gripper means mounted above the lower holding means, slider head means in said gripper means adapted to clamp a warp thread and pull it from said lower holding means during a draw-in stroke of said gripper means, said warp thread held in a loop in said upper holding means being released, after a short delay, and, due to the length of thread so released, said warp thread is pulled through eye means of a weaving component, and means for releasing said warp thread from the gripper means at the end of the draw-in stroke.

2. A draw-in gripper assembly according to claim 1 in which said weaving components are heddles.

3. A draw-in gripper assembly according to claim 1 in which said gripper means comprises slider means adapted to slide in a gripper tube.

4. A draw-in gripper assembly according to claim 3 in which said slider means has an exchangeable slider head means at the end thereof facing a warp thread.

5. A draw-in gripper assembly according to claim 3 including elastic coupling beam means mounted at the drive end of said assembly in engagement with drive fork means mounted on said slider means and said gripper tube.

6. A draw-in gripper assembly according to claim 1 including clamping slot means at the end face of said slider head means.

7. A draw-in gripper assembly according to claim 1 including gripper groove means in said draw-in gripper means at the elevation of said slider head means, said gripper groove means being oblique with respect to the direction of the positioned wrap thread.

* * * * *